US005447307A

United States Patent [19]

Antonious

[11] Patent Number: 5,447,307

[45] Date of Patent: Sep. 5, 1995

[54] GOLF CLUB WITH IMPROVED ANCHOR-BACK HOSEL

[76] Inventor: Anthony J. Antonious, 7738 Calle Facil, Sarasota, Fla. 34238

[21] Appl. No.: 187,536

[22] Filed: Jan. 28, 1994

[51] Int. Cl.[6] ..... A63B 53/02

[52] U.S. Cl. ..... 273/80.2; 273/169; 273/167 G; 273/80 C

[58] Field of Search ..... 273/77 R, 80 R, 80.2, 273/80.3, 80.4, 80.5, 80 C, 169, 167 D, 167 G, 167 K, 167 F

[56] References Cited

U.S. PATENT DOCUMENTS

| | | | |
|---|---|---|---|
| 447,094 | 1/1899 | Nilson . | |
| 1,135,621 | 4/1915 | Roberts . | |
| 1,594,850 | 3/1925 | Perkins . | |
| 2,683,036 | 7/1954 | Klein | 273/167 G |
| 3,519,271 | 5/1967 | Smith . | |
| 4,211,416 | 7/1980 | Swanson . | |
| 4,932,658 | 6/1990 | antonious . | |
| 5,067,711 | 11/1991 | Parente et al. . | |
| 5,183,255 | 2/1993 | Antonious | 273/167 G |
| 5,224,705 | 7/1993 | Scheie et al. | 273/169 |
| 5,335,914 | 8/1994 | Long | 273/169 |
| 5,338,029 | 8/1994 | Falzone | 273/167 G |

FOREIGN PATENT DOCUMENTS 1456982 12/1976 United Kingdom .

*Primary Examiner*—Vincent Millin
*Assistant Examiner*—William M. Pierce
*Attorney, Agent, or Firm*—Finnegan, Henderson, Farabow, Garrett & Dunner

[57] ABSTRACT

An iron the golf club head with an improved anchor-back hosel construction having an upper shaft socket section and a lower section, wherein the lower section of the hosel, in various shapes, emanates from the back of the club head, adjacent the rear of the club face and the heel portion. The hosel extends beyond and away from the heel portion having an upper shaft socket section angularly disposed to be offset, set in-line with, or behind the leading edge of the club face. A longitudinal axis through the upper shaft socket section, if extended, is offset from and non-intersecting with any portion of the club head body.

31 Claims, 9 Drawing Sheets

GOLF CLUB WITH IMPROVED ANCHOR-BACK HOSEL

BACKGROUND AND SUMMARY OF THE INVENTION

The present invention relates to golf club irons, and in particular to a golf club iron having an improved anchor-back hosel construction.

Conventional golf club irons include a hosel connected at the heel end of the club head which attaches the shaft to the head. The hosels of conventional heads extend downwardly in the direction defined by its longitudinal axis, and the metal or other material forming the hosel is positioned symmetrically about its longitudinal axis. The body of the club head and the hosel of conventional clubs are connected to each other at an interface that is substantially parallel to the longitudinal axis of the hosel. Normally, the hosels in conventional club heads do not extend over into the rear of the club head but instead end at the point where the heel and rear face of the club head begin.

Most conventional golf clubs have the leading edge of the club face behind the hosel's center line, which is defined as rearward face progression, with the hosel offset from the club face. Sets of golf clubs having an offset usually have progressive rearward face progression in accordance with the loft of the individual irons. With these designs, the hosel lies in front of the ball striking face and the portion of the hosel which protrudes in front of the face may strike the ball if the club face is swung outside the intended swingline plane through the center of the ball. This results is a shot known as a "shank shot" and causes the ball to veer away from the intended target line at a severe angle.

A number of prior art patented golf club heads relate to shankless golf clubs, including my own U.S. Pat. No. 5,183,255, as well as a number of others described in the background of my patent, the description of which is incorporated herein by reference.

The golf club of the present invention includes a hosel with an upper cylindrical shaft socket section and a lower section. These two sections form an angular hosel in its entirety.

The upper section is generally cylindrical in shape and extends upward at an angle relative to the longitudinal axis of the golf club head body. The upper section includes an elongated opening or socket for accepting a shaft and has a hosel longitudinal axis extending therethrough. The extension of this hosel longitudinal axis is offset from and located outside of the outer periphery of the club head body. In a preferred embodiment, the entire upper section of the hosel is offset from and located beyond the outer periphery of the club head body.

The upper section of the hosel is connected to the club head body through a lower hosel section that starts at the back of the clubhead body and extends over and beyond the heel portion of the club head. This connection can be designed so that the upper cylindrical section can be disposed to set in-line, behind, or beyond the leading edge of the clubface. In all instances, the lower section of the hosel is formed at an angle with the upper shaft section and extends in the same general direction as said club head's longitudinal axis. The lower section of the hosel overlays at least a portion of the rear of the club head body, is directly connected to or integral with the rear surface of the club head body, and projects outwardly and rearwardly away from the rear surface of the club face proximate it. The lower portion of the hosel preferably extends along the longitudinal axis of the club head (an axis which extends from the toe to the heel and through the club head's center of gravity.)

In a preferred embodiment the forwardmost part of the hosel is positioned behind the leading edge of the club face, thereby providing a shankless club head. Preferably, the front portion of the lower hosel section is recessed behind the front of the club head, thereby separating the ball striking face and the upper cylindrical shaft socket section of the hosel. Such an embodiment allows the user to see a clear demarcation between the hosel and the club head's striking face, increasing the likelihood that the user hits a solid shot at the center of the club.

In still another embodiment of the present invention, the lower section of the hosel is extended in a heel to toe direction to provide an elbow between the upper section and the heel of the golf club head. In such an embodiment, the entire upper section of the hosel is offset from and located beyond the outer periphery of the club head body. This elbow spaces the tubular upper section of the hosel further from the heel, provides increased leverage, and decreases the possibility of hitting any ball with the hosel, as opposed to the club face.

In yet another preferred embodiment, the lower section of the hosel originates at or very proximate to the club head's center of gravity and overlays portions of the rear surface and heel of the club head between the point of origin and the upper section of the hosel. In such an embodiment, power from the user can be transferred through this hosel directly to the center of gravity of the club.

As will become apparent, the golf club heads of the present invention provide improved structural integrity and weight and power distribution over conventional clubs. Thus, a dominant feature of the present invention is the unique and innovative hosel structure of golf club head wherein the lower section of the hosel is anchored to the rear face of the club head and provides added mass and power transfer. The hosel construction of the invention, by beginning its formation at the back or rear portion of the club head, increases the stability of the connection between the club head and hosel and produces a more square-faced, solid-feeling stroke when the ball is struck, thereby providing more accuracy and distance.

Club heads with the improved hosel of the present invention produce a more forgiving shot pattern for golf shots which are miss-hits off the center of percussion on the club face because of the additional mass of the club head uniquely located behind the impact area, allowing for increased transfer of energy to a ball at the moment of impact.

Among the objects of the present invention is the provision of an improved iron type golf club head in which the club head's structural and functional characteristics are substantially improved.

Another object of the present invention is to provide an iron type golf club head with a ball striking face which is more clearly defined and distinctively viewed to be separated from the shank or hosel portion of the golf club head, enabling a player to more easily and more confidently line up the golf club head with the ball prior to the execution of the golf shot.

Another object is the provision of a golf club head in which the hosel originates at a position behind the striking face of the club head, improving the connection between the hosel and the club head and imparting maximum energy transfer to a ball being struck.

These and other objects and advantages of the invention will be realized and obtained by means of the elements and combinations particularly pointed out with reference to the following specification and drawings.

It is understood that the foregoing general description and following detailed description are exemplary and explanatory only and are not restrictive of the invention as claimed.

DESCRIPTION OF THE PREFERRED EMBODIMENTS

Figure 1:
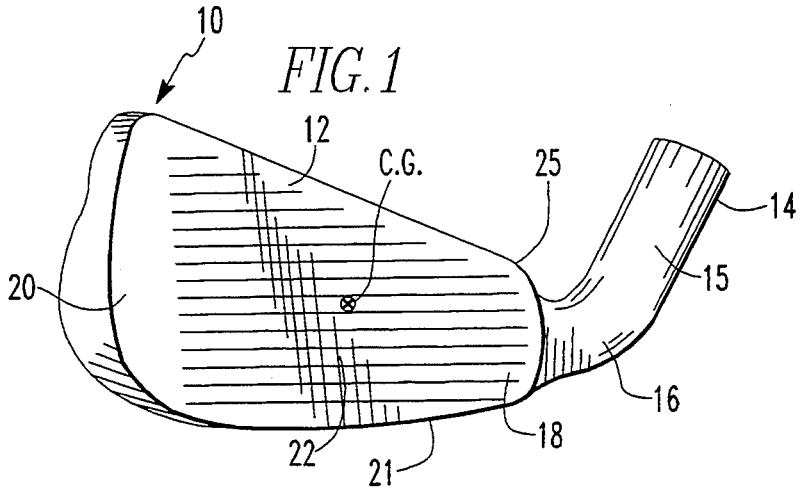
FIG. 1 is a frontal perspective view of an iron type golf club head of the present invention, showing a first embodiment of the improved hosel construction.

Reference will now be made in detail to the present preferred embodiments of the invention, examples of which are illustrated in the accompanying drawings. Wherever possible, the same reference numbers are used throughout the drawings to refer to the same parts. In like manner, corresponding numbers are used between the various embodiments to identify similar parts.

The present invention relates to iron type golf club heads wherein the hosel includes a lower anchor portion that extends toward the toe and is fixed to or integral with the rear face of the club head, providing a strong connection between the upper, shaft socket section of the hosel and the club head. The lower anchor portion originates at the rear surface of the club head, projects rearwardly from the rear surface, and in several embodiments extends from the upper section of the hosel to a point of origin on the rear surface positioned at or beyond the club head's center of gravity.

In certain preferred embodiments, the hosel is attached in a manner such that the leading edge of the ball striking face is in front of the hosel. Because of the position of the hosel in these embodiments, the possibility of a shot being shanked is virtually eliminated should the ball be struck at the heel area on the club face.

The structure of preferred embodiments of the present invention also separates the ball striking face from the hosel, providing a visually more effective relationship between the club face and the ball. This is achieved by forming a recess in the lower section of the hosel, between the heel of the club head and the upper shaft section of the hosel. These embodiments enable a golfer to swing the club with more confidence, resulting in better execution of the golf shot.

Referring to the drawings, FIGS. 1 to 8 show a typical cavity back weighted golf club head 10 having incorporated therein an anchor back hosel in accordance with the present invention. The golf club head 10 includes a club head body 12, a hosel 14, heel 18, a toe 20, and ball striking face 22 having a center of gravity (c.g.) approximately in a middle of the ball striking face. It will be appreciated that the club head is designed to be assembled to a shaft and grip through the hosel 14. The ball striking face 22 intersects with a forwardmost progression of the bottom sole 19 to define a leading edge 21 of the golf club face. The most outward exterior, front surfaces of the heel portion, toe portion, and ball striking face define an outer periphery 25 of the club head, which extends completely around the club head.

The hosel 14 is permanently and non-rotatably fixed to the club head body. The hosel 14 is formed of an upper, generally cylindrical, section 15 and a lower section 16 which connects directly to the club head body 12. These two sections form an angular hosel, which in certain preferred embodiment is L-shaped.

Figure 2:
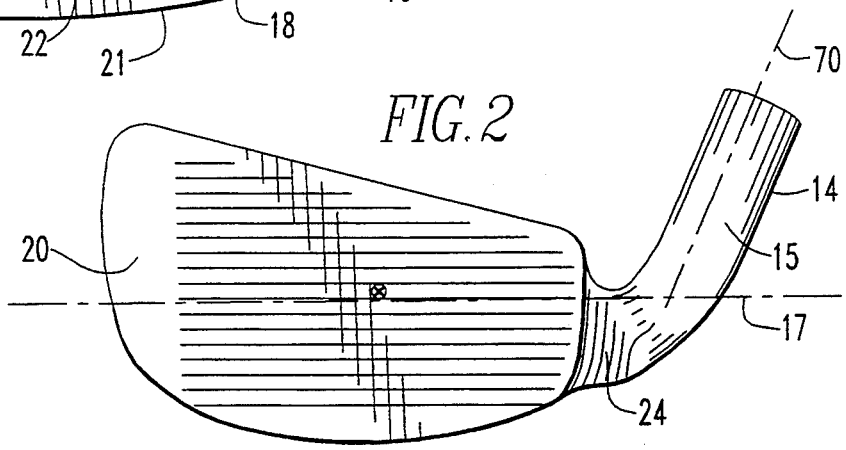
FIG. 2 is a frontal elevational view of the golf club head of FIG. 1.

The upper shaft-socket section 15 of hosel 14 includes an elongated opening or socket for accepting a club shaft. Preferably, the shaft socket extends downward to a point approximately aligned with the club head body's longitudinal axis 17, which extends from the heel to the toe of the club head and intersects with the club head's center of gravity. The upper section 15 of the hosel is generally cylindrical in shape and extends upwardly at an angle relative to the longitudinal axis 17 of the golf club head body. The upper section of the hosel has a hosel longitudinal axis 70 which is coincident with the axis of the socket within the hosel. As shown in FIG. 2, an extension of this longitudinal axis 70 is offset from and located outside of the outer periphery 25 of the club head body. In the embodiment shown in FIGS. 1–8, the entire section 15 of hosel 14 is offset from and located beyond the outer periphery 25 of the club head body.

Figure 3:
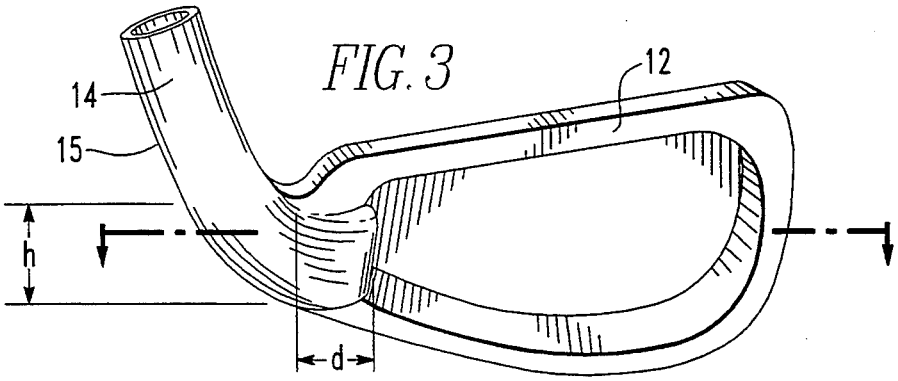
FIG. 3 is a rear elevational view of the golf club head of FIG. 1.

The upper section 15 of the hosel is connected to the club head body through lower hosel section 16 which is formed at an angle with the upper shaft socket section. Lower section 16 originates from the rear surface of the club head and extends in the same general direction as the club head longitudinal axis 17. The lower section 16 of the hosel is elongated in a heel to toe direction and extends from the upper section 15 of the hosel toward the toe and within the outer periphery 25 of the club head body. As seen in FIG. 3, the lower section 16 is directly connected to and overlays at least a portion of the rear surface of the club. As will be described in more detail below and as shown in certain figures of this application, the lower section 16 may extend to or beyond the center of gravity of the club head. The lower section preferably extends along the longitudinal axis 17 of the club head and most preferably is symmetrically positioned about the longitudinal axis 17.

In the preferred embodiments, the lower section 16 of the hosel includes a bulbous rear portion 26 which is formed at the back of the club head body 12, adjacent the rear club face 27, to provide strength and structural integrity between the club head body 12 and the shaft socket section 15 of the hosel 14. This bulbous portion 26 extends rearwardly from the rear of the club head. As seen, this bulbous rear portion, and indeed the majority of the lower section 16 of the hosel, is positioned on the toe side of the longitudinal axis 70 of the hosel. As will be explained in more detail below, the lower section of the hosel in several embodiments includes an extended weight member that extends further toward the toe and projects rearwardly from the rear of the club head.

As shown in FIG. 3, the lower section of the hosel extends beyond the outer periphery of the club head by a distance "d" which is at least $\frac{1}{4}$ inch, preferably at least $\frac{3}{8}$ inch, and most preferably at least $\frac{1}{2}$ inch. As shown in FIG. 3, the lower section 16 has a height "h" at the rear of the club of at least $\frac{1}{4}$ inch, preferably at least $\frac{3}{8}$ inch, and most preferably $\frac{1}{2}$ inch. The lower section 16 extends outwardly from the rear of the club by a distance of at least $\frac{1}{8}$ inch, preferably at least 3/16 inch, and most preferably at least $\frac{1}{4}$ inch. These general dimensions are equally applicable to the various embodiments disclosed in this application. The portion of the lower section of the hosel that projects from the rear of the club head in most instances is both aligned with and parallel to longitudinal axis of the club head.

The hosel of the present invention can be applied to a club head body so that the hosel is in line with, behind, or in front of the leading edge of the club head. In the embodiment illustrated in FIGS. 1–8, the front surface 30 of the hosel 14 is positioned behind the leading edge 21 of the ball striking face 22. This arrangement virtually eliminates the possibility of shanking by placing the leading edge 21 of the ball striking face in front of the hosel 14.

In the embodiment shown in FIGS. 1–8, the club head includes an elbow 24, which is an extension of the lower section 16 of the hosel formed between the heel 18 of the club head and the upper portion 15 of the hosel. The elbow 24 connects the heel and hosel but also spaces the hosel from the outermost edge of the outer periphery 35 at the heel. The elbow 24 includes an upper surface or top and a lower surface or bottom. Preferably, the upper surface is positioned below the uppermost toe portion of the club head, more preferably below the midpoint of top ridge. Similarly, in the preferred embodiment, the lower surface of the elbow is spaced upwardly from a line defined by an extension of the leading edge. The elbow preferably is at least one eighth of an inch wide, in a toe to heel direction, and more preferably at least a quarter of an inch wide. The elbow preferably has a height, in a sole to top ridge direction, of at least half an inch.

The elbow increases the distance between the hosel and the heel of the club head, thereby further minimizing any possibility of a golf ball being struck against the hosel if an extremely faulty swing is made by a golfer. Through the use of the elbow, the distance from the axis of the shaft to the center of gravity of the club head is increased without enlarging the club face size, thereby providing a club head having an increased leverage effect, without the increased drag and weight resulting from enlarged club heads.

Figure 4:
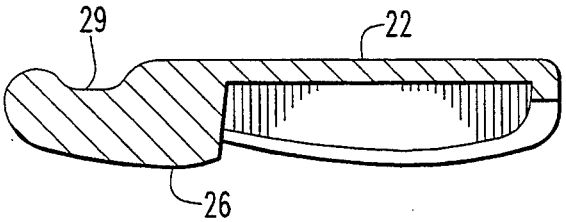
FIG. 4 is a sectional view of the golf club head of FIG. 1, taken along the lines 4—4 of FIG. 3.
Figure 6:
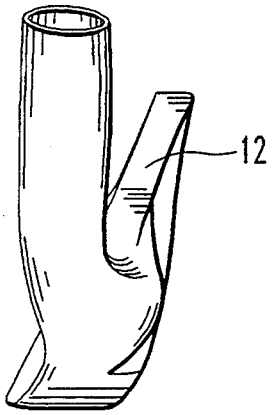
FIG. 6 is a heel end elevational view of the golf club of FIG. 1.
Figure 5:
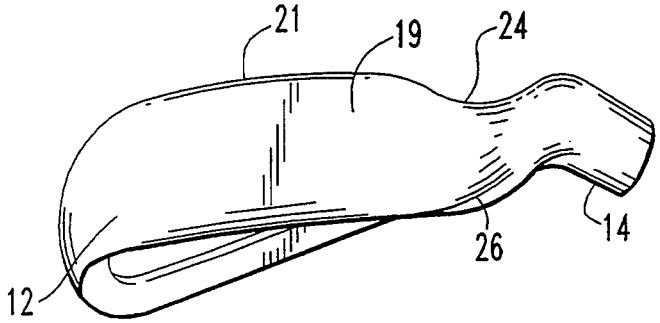
FIG. 5 is a bottom view of the golf club head of FIG. 1.
Figure 7:
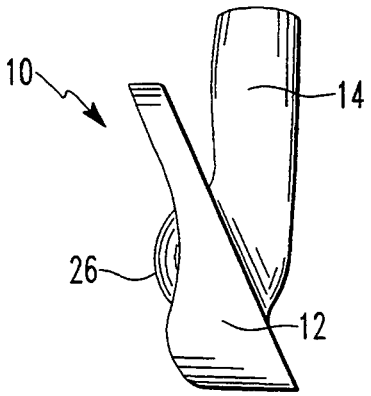
FIG. 7 is a toe end elevational view of a golf club head of FIG. 1.
Figure 8:
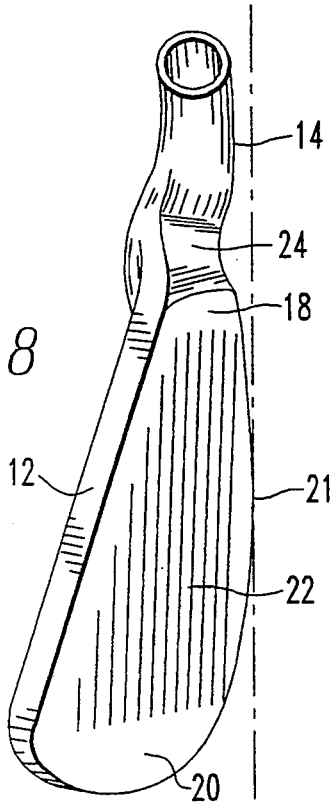
FIG. 8 is a top plan view of the golf club of FIG. 1.

In the preferred embodiment, the lower section 16 is formed with a frontal recess 29, as best seen with reference to FIG. 4. The frontal recess 29 provides the golfer with a clear visual demarcation between the striking face 22 and the hosel of the club head and therefore minimizes the potential for miss-hits.

Figure 9:
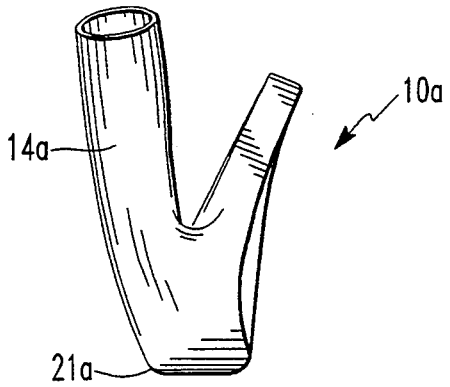
FIG. 9 is a heel end elevational view of a conventional golf club.
Figure 10:
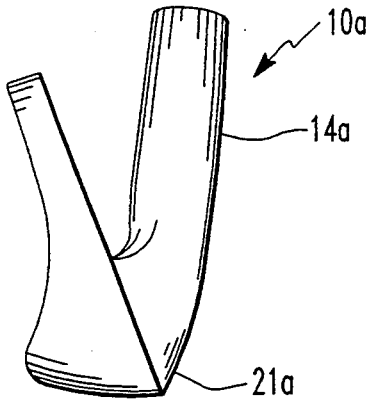
FIG. 10 is a toe end elevational view of a conventional golf club.
Figure 11:
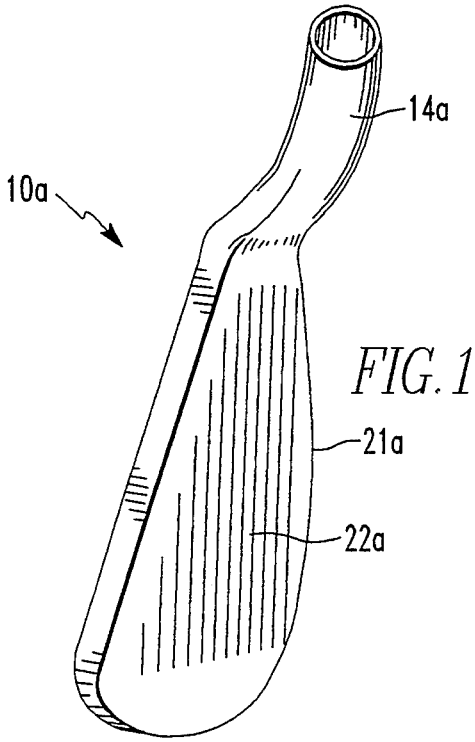
FIG. 11 is a top plan view of a conventional golf club.
Figure 12:
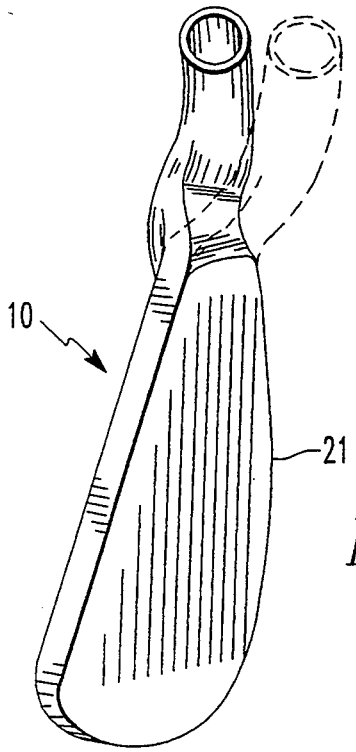
FIG. 12 is a top plan view of a club head of the present invention, with the location of the hosel of a conventional golf club shown in phantom for comparison.
Figure 13:
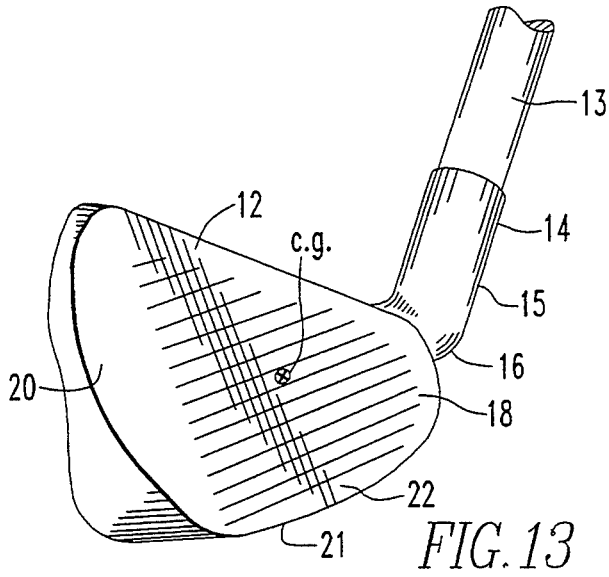
FIG. 13 is a front perspective view of a second embodiment of a golf club head in accordance with the present invention.
Figure 14:
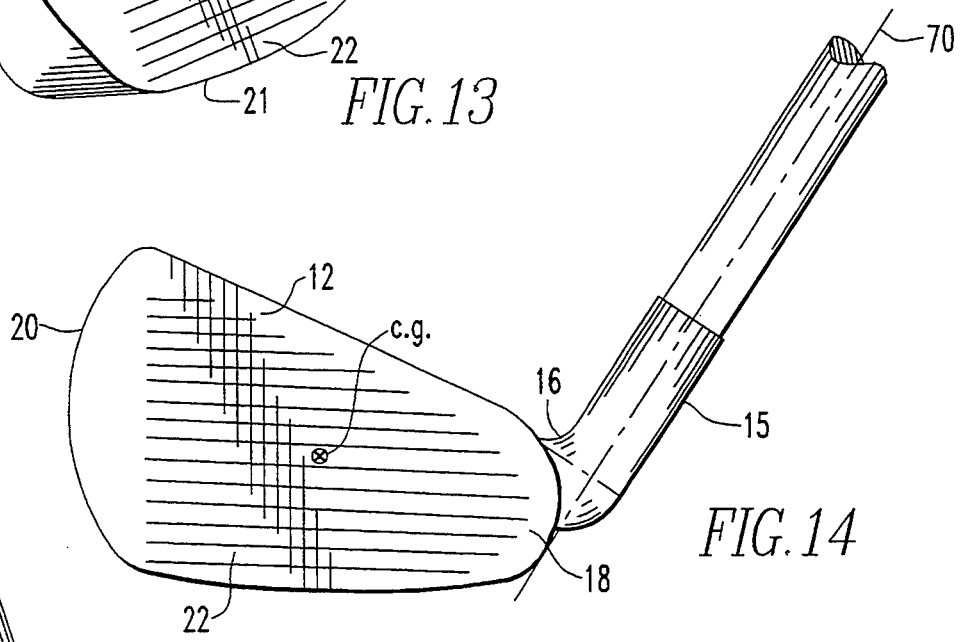
FIG. 14 is a front elevational view of a golf club head of FIG. 13.
Figure 15:
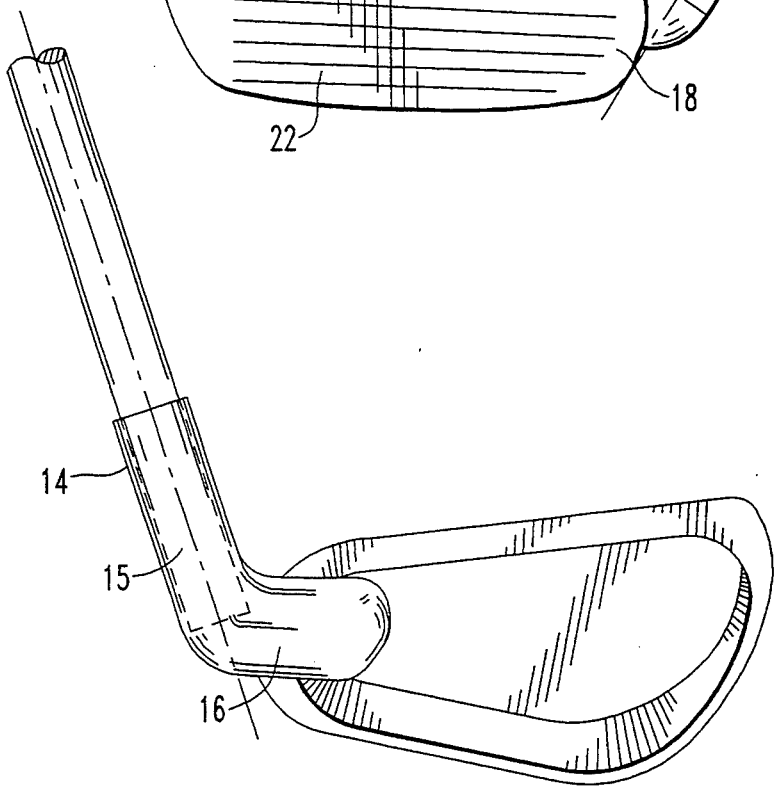
FIG. 15 is a rear elevational view of a golf club head of FIG. 13.

FIGS. 9, 10 and 11 show views of a conventional golf club head **10*a* where the hosel 14*a* is connected to the club head body at the heel of the club head In this conventional club head, none of the hosel extends over and onto the rear surface of the club head. In the illustrated conventional club head, the hosel is positioned in front of the leading edge 21***a* of the club face 22*a*. It will be appreciated with reference to FIG. 12 that the hosel location of the conventional club 10*a* differs from the hosel location of the embodiment shown in FIGS. 1–8, which is behind the leading edge 21.

FIGS. 13 to 21 show a second embodiment of a club head in accordance with the present invention. The club head is a typical cavity-back weighted club head having a club head body 12, a hosel 14 connected to a shaft 13, a heel 18, a toe 20, ball striking face 22 with a center of gravity (c.g.) approximately in the middle thereof, and a sole 19. As seen in the drawings, particularly in FIGS. 14 and 15, the hosel 14 includes an upper, generally cylindrical shaft socket section 15 and a lower section 16 angularly attached to the upper portion and connected directly to the rear club face 27 of the club head 1000. Again referring to FIGS. 14 and 15, the longitudinal axis 70 of the upper portion of the hosel, if extended, passes outside the outer perpiphery 25 of the club head body, thus separating the club head body from the upper hosel section.

The forward face of the hosel 14 illustrated in FIGS. 13 to 21 is connected directly to the rear club face surface 27 of the club head body 12. The lower section 16 of the hosel, as in the earlier embodiment, is generally in alignment with and parallel to the longitudinal axis of the club head. In the embodiment shown, the lower section 16 extends along and is generally symmetrically positioned about the longitudinal axis of the club head. The distal end of the lower section 16 most proximate the toe (the point or origin of the hosel) extends beyond the perimeter weighting at the heel and connects directly to the rear face 27 of the club head.

Figure 16:
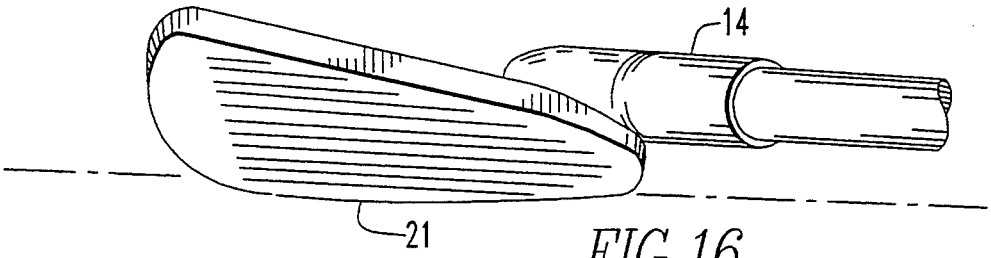
FIG. 16 is a top plan view of the golf club head of FIG. 13.
Figure 17:
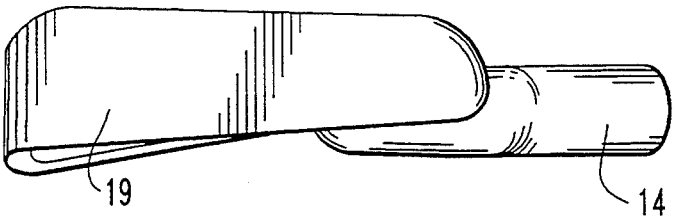
FIG. 17 is a bottom view of a golf club head of FIG. 13.
Figure 18:
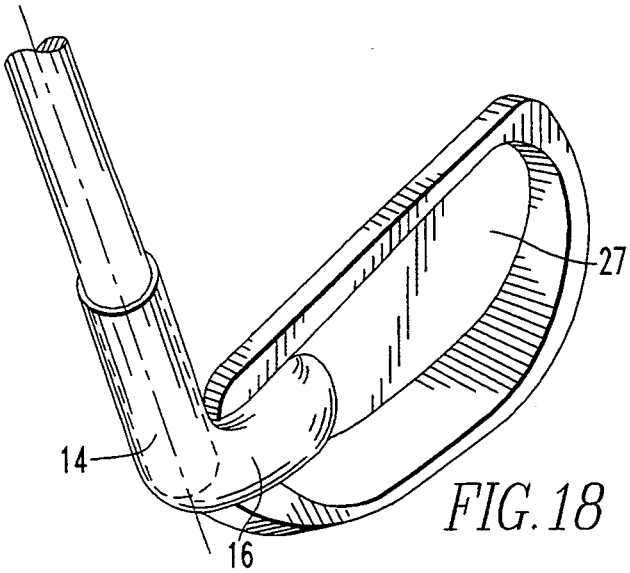
FIG. 18 is a rear perspective view of a golf club head of FIG. 13.
Figure 19:
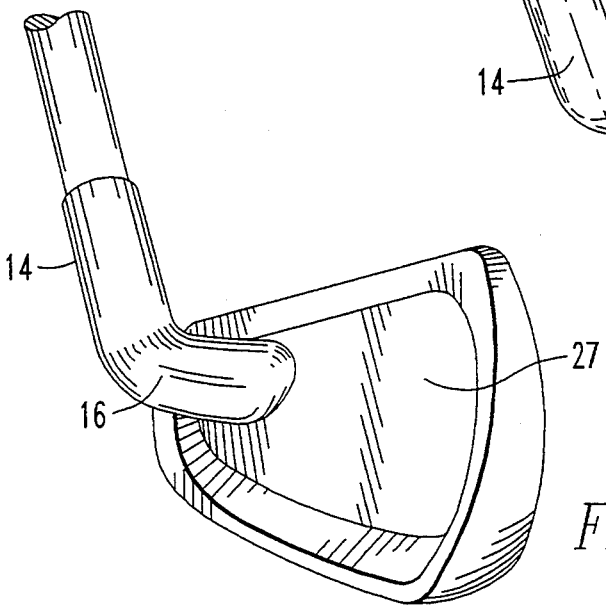
FIG. 19 is another rear perspective view of a golf club head of FIG. 13.
Figure 20:
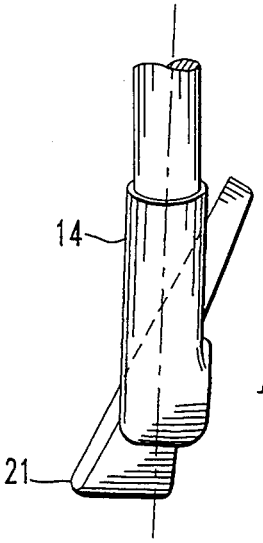
FIG. 20 is a heel end elevational view of a golf club head of FIG. 13.
Figure 21:
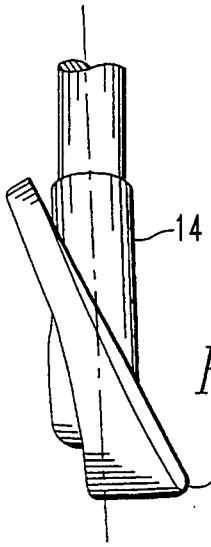
FIG. 21 is a toe end elevational view of a golf club head of FIG. 13.
Figure 22:
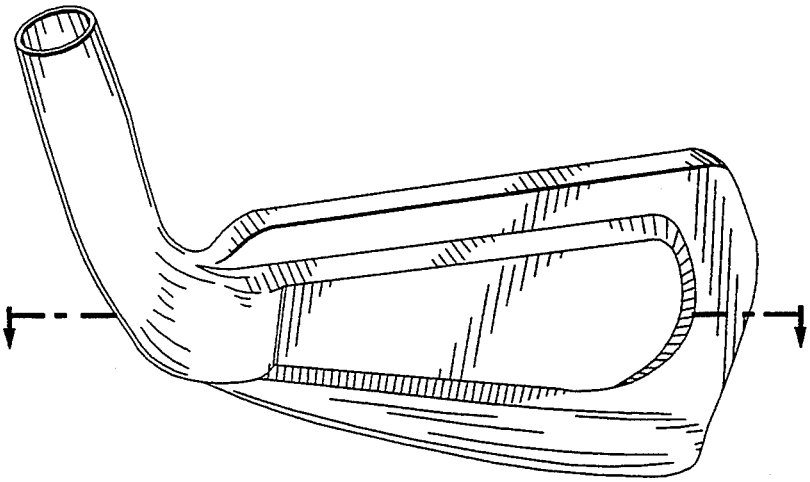
FIG. 22 is a rear elevational view of a third embodiment of a golf club head in accordance with the present invention.
Figure 23:
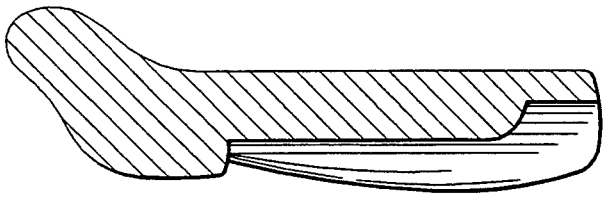
FIG. 23 is a sectional view of the golf club head of FIG. 22, taken along lines 23—23 of FIG. 22.
Figure 24:
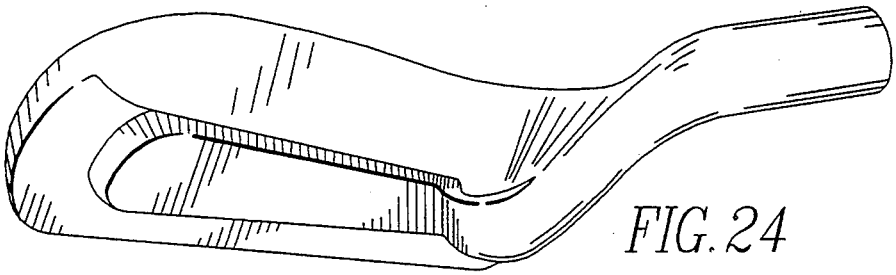
FIG. 24 is a bottom perspective view of the golf club head of FIG. 22.
Figure 25:
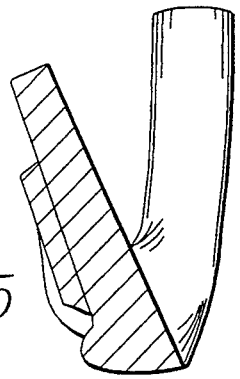
FIG. 25 is a cross sectional view of the golf club head of FIG. 22.

Referring to FIG. 16, that the forwardmost portion 30 of the hosel is behind the club face leading edge 21 of the club head. As with the previous embodiments, this produces a shankless or shankproof golf club head. The embodiment shown in FIGS. 13 to 21 also visually separates the club head body 12 from the shaft socket section 15 of the hosel 14, enabling a player to have a completely unobstructed view of the ball and the entire club face 22 available for making ball contact, while the golfer is lining up for the execution of a particular shot.

A third embodiment of the present invention is illustrated in FIGS. 22–25. In that embodiment an anchor-back hosel is formed on a muscle back type of iron-type head. As shown, the hosel includes the general elements and attributes described in the embodiment of FIGS. 1–8. In this embodiment, however, the lower section 16 includes an additional weight member 30 in the form of a longitudinal extension which extends beyond the club head's center of gravity, is symetically positioned about the club head's longitudinal axis 17, and which projects rearwardly from the rear face of the club head.

In the embodiment shown in FIGS. 22–25, the lower section extends to approximately the toe of the club head and is spaced from the outer periphery of the club head. In this embodiment, the hosel extends beyond the leading edge of the club face and forms a pocket at the point where the front of the club face and front of the hosel meet. This particular club head therefore has a shank portion. However, the club head could also be designed to avoid such a pocket, by the structures and relationships disclosed with respect to the embodiments shown in FIGS. 1–8 and 13–21.

Figure 26:
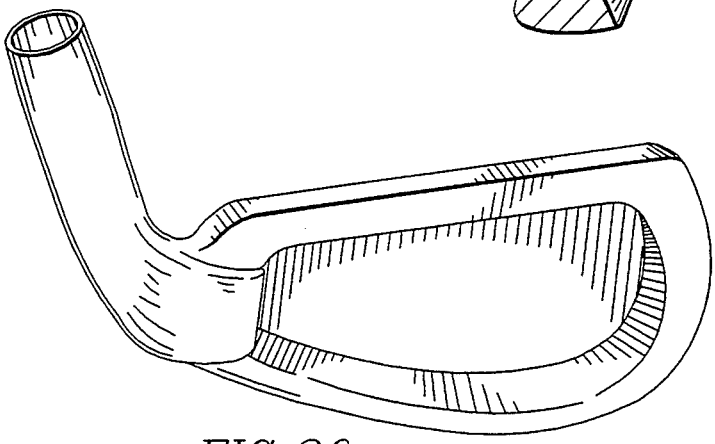
FIG. 26 is a rear elevational view of a fourth embodiment of a golf club head in accordance with the present invention.
Figure 27:
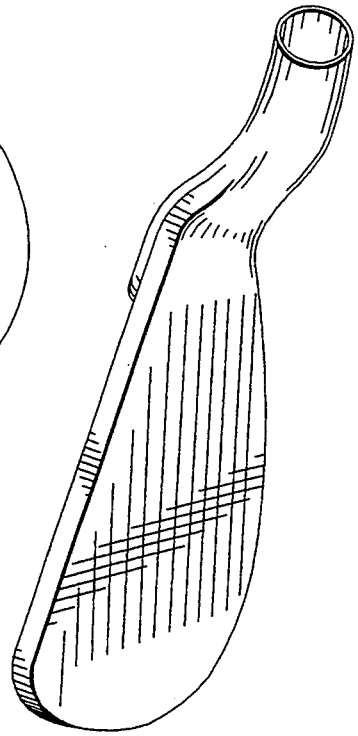
FIG. 27 is a top plan view of the golf club head of FIG. 26.

FIGS. 26 and 27 illustrate another embodiment of the present invention, which is the similar to the embodiment shown in FIGS. 1–8, except that the hosel extends forward beyond the leading edge 21 of the club head. This illustration is included to clearly disclose that the present invention can be applied to irons that include a shank portion.

Other embodiments, as shown in FIGS. 28 to 38, are similar to the embodiments shown and described in FIGS. 1 to 8 and 13–27, with the exception that the lower section 16 of the hosel includes an extended, integral weight member 30. The weight member can be applied to any of the previously disclosed embodiments as well as other embodiments that fall within the spirit of the invention. The weight member 30 extends in a heel to toe direction on the back face of the club head in each of these embodiments and effectively extends the lower section of the hosel to or beyond the club head's center of gravity. The weight members are fixed to or integral with the rear surface of the club head body.

Figure 28:
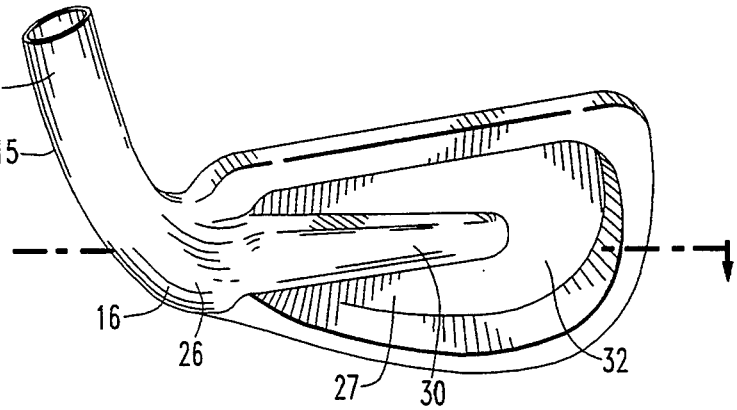
FIG. 28 is a rear elevational view of another embodiment of the gold club head of the present invention.
Figure 29:
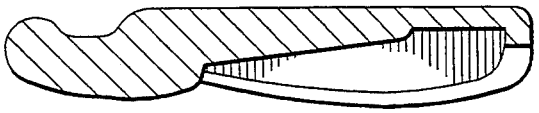
FIG. 29 is a sectional view taken along the lines 14—14 of FIG. 28.

Referring to FIGS. 28 and 29, the illustrated embodiment of a golf club head in accordance with the present invention includes a club head body 12 and a hosel 14, including an upper shaft socket section 15 and a lower section 16. The front of the club head is the same as the embodiments shown in FIGS. 1 to 8. In this embodiment, a bulbous rear portion 26 extending rearwardly from the lower portion 16 of the hosel 14 includes a weight member in the form of a tapered projection 30, as best seen in FIG. 29, which extends into a cavity 32 formed by a peripheral weight 34 on a rear club face 27 of the club head. The weight member extends beyond the club head's center of gravity and preferably passes through the club head's center of gravity. The weight member shown in this embodiment, as well as the other embodiments, has a thickness (in the front to rear direction) of at least 1/16 inch and preferably at least ⅛ inch. This particular weight member decreases in thickness as it extends toward the toe. This tapered projection 30 is integrally connected to the lower section 16 of hosel 14 as well as to the rear face of the club head.

Figure 30:
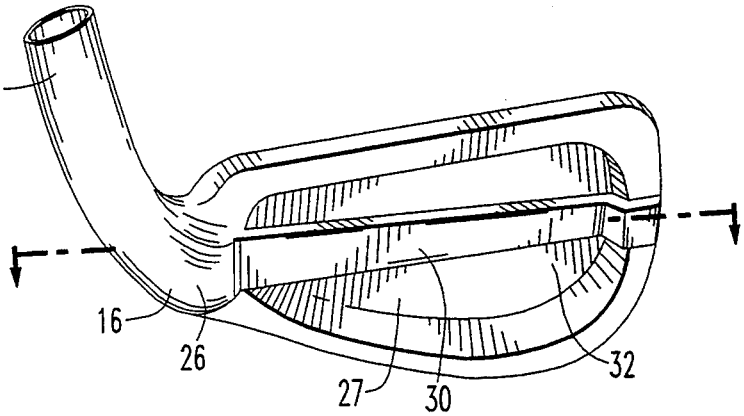
FIG. 30 is a rear elevational view of another embodiment of a golf club head in accordance with the present invention.
Figure 31:
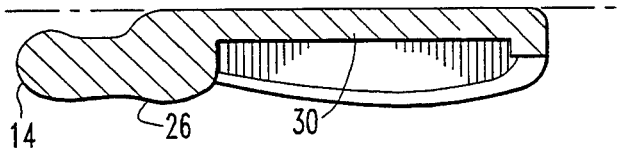
FIG. 31 is a sectional view taken along the lines 31—31 of FIG. 30.

FIGS. 30 and 31 show another embodiment of a golf club head in accordance with the present invention, having a hosel 14 including a lower section 16 with a bulbous rearwardly extending portion 26. A weight strip 30 is integrally formed as part of the lower section 16 and extends across the entire width of a cavity 32 on a rear club face 27 of the club head. As can be seen, the weight strip 30 extends onto a peripheral weight 34 at the toe of the club head.

Figure 32:
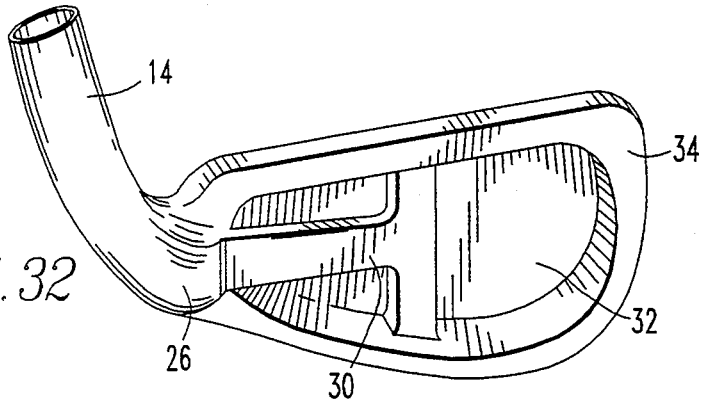
FIG. 32 is a rear elevational view of another embodiment of a golf club head in accordance with present invention.

FIG. 32 shows another embodiment of a golf club head in accordance with the present invention, including a T-shaped weight element 30 integrally connected to a bulbous rear portion 26 of the hosel 14. The weight element 30 extends partway into a rear cavity formed by a peripheral weight and includes a weight section in a heel to toe direction and a weight section extending in a top to bottom direction between upper and lower edges of the peripheral weight 34 proximate the center of the club head. The T-shaped weight member preferably has the center of the T positioned at the club head's center of gravity.

Figure 33:
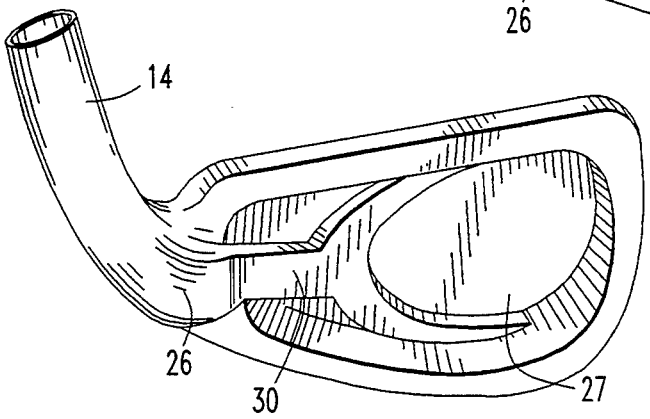
FIG. 33 is a rear elevational view of another embodiment of a golf club head in accordance with the present invention.

FIG. 33 shows another embodiment of a golf club head again similar to the club head 10 of FIGS. 1 to 8, having a weight member in the form of a Y-shaped projection 30 integrally attached to a bulbous rear portion 26 of the hosel 14, which extends into a cavity 32 on the rear club face 27 of the club head. The two distal ends of the Y connect to the peripheral weights 34 of the illustrated club head.

Figure 34:
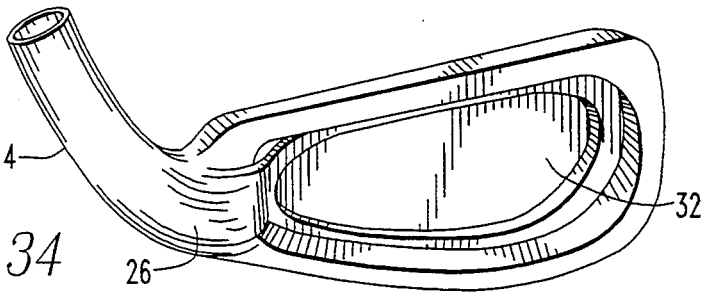
FIG. 34 is a rear elevational view of another embodiment of a golf club head in accordance with the present invention.

FIG. 34 shows another embodiment of a golf club head, including a weight in the form of a loop 30 extending from a bulbous rear portion 26 of the hosel 14 which extends around the entire periphery of a cavity 32 formed on the rear club face 27 of club head. In this embodiment the weight member is connected to the perimeter weighting 34 of the club, along its entire perimeter.

Figure 35:
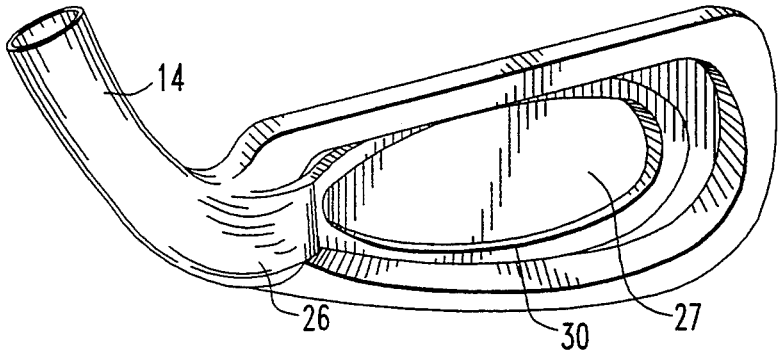
FIG. 35 is a rear elevational view of another embodiment of a golf club head in accordance with the present invention.

FIG. 35 shows another embodiment of a golf club head in accordance with the present invention, including a loop-shaped weight 30 integrally connected to a bulbous rear portion 26 of the hosel 14. The loop-shaped projection 30 extends partway around the periphery of the cavity 32 formed on the rear club face 27 of the club head.

Figure 36:
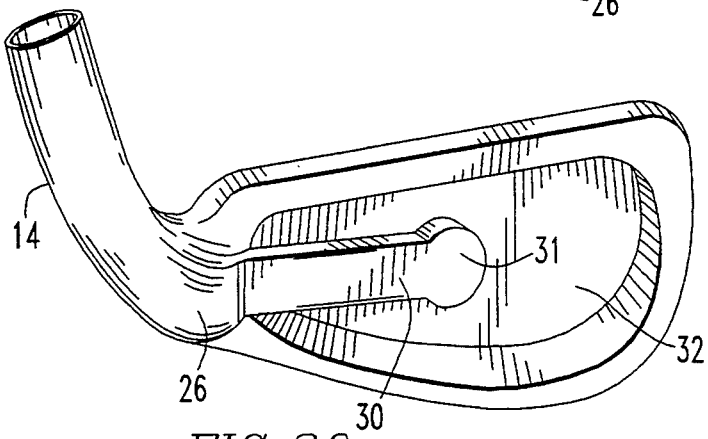
FIG. 36 is a rear elevational view of another embodiment of a golf club head in accordance with the present invention.

FIG. 36 shows another embodiment of a golf club head in accordance with the present invention, including a weight in the form of a projection 30 integrally attached to a bulbous rear portion 26 of the hosel 14, which includes a secondary circular weight 31 at the distal end of the projection 30, which extends into the cavity 32 proximate the center of gravity of the club head.

Figure 37:
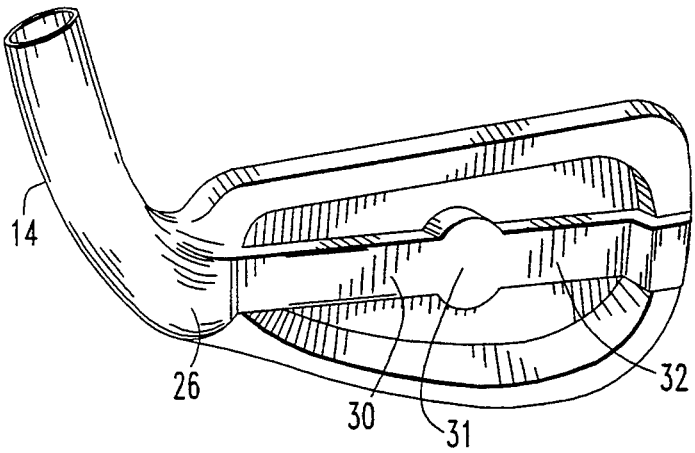
FIG. 37 is a rear elevational view of another embodiment of a golf club head of the present invention.

FIG. 37 shows another embodiment of a golf club head in accordance with the present invention, including a weight in the form of a longitudinal strip 30 integrally connected with a bulbous rear portion 26 of the hosel 14. The strip extends the entire length of the rear cavity 32 to the toe 20 and includes a circular secondary weight member 31 proximate the center of gravity of the club head.

Figure 38:
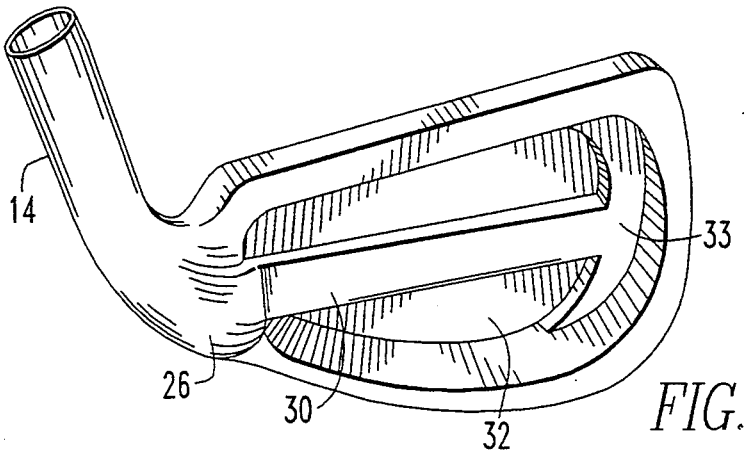
FIG. 38 is a rear elevational view of another embodiment of a golf club head in accordance with the present invention.

FIG. 38 shows yet another embodiment of a golf club head of the present invention, including a weighted strip 30 integrally formed with a rear bulbous portion 26 of the hosel 14, which terminates in a toe weight 33 formed within the cavity 32.

Whereas the inventions have been principally described on cavity back, peripheral weighted types of golf clubs, it will be appreciated that any of the hosel and rear weight structures and/or combination of structures may be formed on a wide variety of club heads including plain rear faces or "muscle-back" golf club heads.

It will be apparent to those skilled in the art that various other modifications and variations may be made in the golf club head of the present invention, without departing from the spirit or scope of the present invention, as defined in the following claims.

I claim:

1. An iron type golf club head for hitting a golf ball comprising:

a golf club head body having a heel, a toe, a bottom sole, a planar, lofted ball striking face having a loft greater than 12 degrees, the ball striking face intersecting with a forwardmost progression of said bottom sole to define a leading edge of the ball striking face of said golf club, a club head longitudinal axis through said club head body in a heel to toe direction, a rear surface, and an outer periphery of said club head defined by an most outward exterior, front surfaces of said heel, toe and ball striking face;

and a hosel permanently and non-rotatably fixed to said club head body, said hosel having an upper shaft-socket section for connection to a golf club shaft, said upper shaft-socket section being generally cylindrical in shape and extending upwardly at an angle relative to said longitudinal axis of the golf club head body, and a lower section connected to said upper section and formed at an angle with said upper shaft-socket section, said lower section originating from the rear surface of said club head body and extending in the same general direction as said club head longitudinal axis;

said upper shaft-socket section of said hosel having a hosel longitudinal axis therethrough, an extension of which is offset from and located in a toe to heel direction outside of the outer periphery of said club head body;

said lower section of said hosel being elongated in a heel to toe direction, extending within the outer periphery of the club head body, and being connected to and overlaying at least a portion of said rear surface.

2. The golf club head of claim 1 wherein the forwardmost portion of said hosel is behind, in a front face to rear surface direction, the leading edge of said club face.

3. The golf club head of claim 1 wherein the forwardmost portion of said hosel is ahead, in a front face to rear surface direction, of the leading edge of said club face.

4. The golf club head of claim 1 wherein the forwardmost portion of said hosel is in line, in a front face to rear surface direction, with the leading edge of said club face.

5. The golf club head of claim 1 wherein the entire upper shaft-socket section of said hosel is offset from and located in a toe and heel direction beyond the outer periphery of said club head body.

6. The golf club head of claim 5 wherein said lower portion includes a recess on a frontmost portion thereof, said recess being located between said ball striking face adjacent said heel and said upper shaft-socket section of said hosel.

7. The golf club head of claim 1 wherein said upper section and said lower section of said hosel combine to form a generally L-shaped hosel.

8. The golf club head of claim 1 wherein said lower section of said hosel extends along said longitudinal axis of said golf club head body.

9. The golf club head of claim 1-wherein said lower section of said hosel has a height in a top to bottom direction of at least $\frac{3}{8}$ inch.

10. The golf club head of claim 1 wherein said lower section of said hosel extends outwardly from the rear surface of the club head by at least $\frac{1}{8}$ inch.

11. The golf club head of claim 1 further comprising a weight member which is connected to and extends from the lower section of the hosel, said weight member extending in a heel to toe direction to at least the center of gravity of the club head body and projecting rearwardly from the rear surface of the club face.

12. The golf club head of claim 11 wherein said weight member is symmetrically positioned about the longitudinal axis of the club head.

13. The golf club head of claim 11 wherein said weight member extends the entire length of said cavity in a heel to toe direction.

14. The golf club head of claim 11 wherein said weight member is T-shaped, including a first element formed in a heel to toe direction and a second element perpendicular thereto proximate said center of gravity in a direction between upper and lower surfaces of said club head.

15. The golf club head of claim 11 wherein said weight member is a Y-shaped projection extending in a heel to toe direction on the rear surface of said club head.

16. The golf club head of claim 11 wherein said weight member is a loop extending around an inner periphery of a cavity formed on said rear club face.

17. The golf club head of claim 11 wherein said weight member is a loop extending partway into a cavity formed on said rear surface club face.

18. The golf club head of claim 11 wherein said weight member includes a first longitudinal weight element extending in a heel to toe direction along the longitudinal axis of the club head and second weight element located approximately opposite the center of gravity of said club head.

19. The golf club head of claim 1, wherein the lower shaft-socket section extends beyond the heel in a toe to heel direction.

20. An iron type golf club head for hitting a golf ball comprising:

a golf club head body having a heel, a toe, a bottom sole, a planar, lofted ball striking face having a loft greater than 12 degrees, the ball striking face intersecting with a forwardmost progression of said bottom sole to define a leading edge of the ball striking face of said golf club, a club head longitudinal axis through said club head body in a heel to toe direction, a rear surface, and an outer periphery of said club head defined by an most outward exterior, front surfaces of said heel, toe and ball striking face;

and a hosel permanently and non-rotatably fixed to said club head body, said hosel having an upper shaft-socket section for connection to a golf club shaft, said upper shaft-socket section being generally cylindrical in shape and extending upwardly at an angle relative to said longitudinal axis of the golf club head body and a lower section connected to said upper section and formed at an angle with said upper shaft-socket section, said lower section originating from the rear surface of said club head body and extending in the same general direction as said club head longitudinal axis;

said upper shaft-socket section of said hosel having a hosel longitudinal axis therethrough, an extension of which is offset from and located in a toe to heel direction outside of the outer periphery of said club head body;

said lower section of said hosel being elongated in a heel to toe direction, extending within the outer periphery of the club head body, and being connected to and overlaying at least a portion of said rear surface;

the forwardmost portion of said hosel being behind, in a front face to rear direction, the leading edge of said club face.

21. The golf club head of claim 20 wherein the entire upper shaft -socket section of said hosel is offset from and located in a toe to heel direction beyond the outer periphery of said club head body.

22. The golf club head of claim 21 wherein said lower portion includes a recess on a frontmost portion thereof, said recess being located between said ball striking face adjacent said heel and said upper shaft-socket section of said hosel.

23. The golf club head of claim 21 further comprising a weight member which is connected to and extends from the lower section of the hosel, said weight member extending in a heel to toe direction to at least the center of gravity of the club head body and projecting rearwardly from the rear surface of the club face.

24. The golf club head of claim 23 wherein said weight member is a loop extending around an inner periphery of a cavity formed on said rear club face.

25. The golf club head of claim 24 wherein said weight member extends the entire length of said cavity in a heel to toe direction.

26. The golf club head of claim 20 wherein said lower section of said hosel extends along the longitudinal axis of said club head body.

27. The golf club head of claim 26 Wherein said lower section of said hosel is positioned symmetrically about the longitudinal axis of said club head body.

28. The golf club head of claim 26 wherein said lower section of said hosel has a height in a top to bottom direction of at least $\frac{3}{8}$ inch.

29. The golf club head of claim 28 wherein said lower section of said hosel extends outwardly from the rear surface of the club head by at least $\frac{1}{8}$ inch.

30. The golf club head of claim 29 wherein said lower section of said hosel extends within the outer periphery of said club head body, in a heel to toe direction, by at least $\frac{1}{2}$ inch.

31. The golf club head of claim 20, wherein the lower shaft-socket section extends beyond the heel in a toe to heel direction.

* * * * *

UNITED STATES PATENT AND TRADEMARK OFFICE

CERTIFICATE OF CORRECTION

PATENT NO. : 5,447,307

DATED : September 5, 1995

INVENTOR(S) : Anthony J. Antonious

It is certified that error appears in the above-indentified patent and that said Letters Patent is hereby corrected as shown below:

On the title page, item [57]

In the "ABSTRACT", front page, line 1, change "the" to --type--.

Claim 9, column 10, line 43, delete "-".

Claim 17, column 11, line 8, delete "surface".

Claim 20, column 12, line 7, delete "face".

Signed and Sealed this

Fifteenth Day of July, 1997

Bruce Lehman

*Attest:*

BRUCE LEHMAN

*Attesting Officer*

*Commissioner of Patents and Trademarks*